US007269969B2

(12) United States Patent
Strickland et al.

(10) Patent No.: US 7,269,969 B2
(45) Date of Patent: Sep. 18, 2007

(54) DOUBLE COOLER "THE COOLER COOLER" ICE AND BEVERAGE COMBINATION

(76) Inventors: Marc Duane Strickland, 2900 Abington La., Raleigh, NC (US) 27604; Chris Alan Arendt, 8421 Glenwood Ave., Raleigh, NC (US) 27612

( * ) Notice: Subject to any disclaimer, the term of this patent is extended or adjusted under 35 U.S.C. 154(b) by 0 days.

(21) Appl. No.: 10/760,163

(22) Filed: Jan. 20, 2004

(65) Prior Publication Data

US 2007/0107459 A1 May 17, 2007

(51) Int. Cl.
*B67D 5/62* (2006.01)

(52) U.S. Cl. ..... 62/400; 62/457.3; 62/457.7; 222/129; 220/592.16; 220/592.23

(58) Field of Classification Search ..... 62/400, 62/457.3, 390, 457.1, 457.2, 459, 457.7; 220/592.16, 592.18, 592.19, 506; 222/129, 222/142.5

See application file for complete search history.

(56) References Cited

U.S. PATENT DOCUMENTS

| | | | | | |
|---|---|---|---|---|---|
| 57,281 | A | * | 8/1866 | Blocher | 62/400 |
| 71,899 | A | * | 12/1867 | Murden et al. | 62/400 |
| 235,044 | A | * | 11/1880 | Thompson | 210/337 |
| 531,838 | A | * | 1/1895 | Davis et al. | 210/123 |
| 685,063 | A | * | 10/1901 | Sauer | 217/75 |
| 1,576,912 | A | * | 3/1926 | James | 222/130 |
| 1,732,996 | A | * | 10/1929 | Wandel | 222/129 |
| 2,104,684 | A | | 1/1938 | Wilson, Jr. | |
| 2,338,455 | A | * | 1/1944 | Petri | 220/592.16 |
| 2,716,508 | A | * | 8/1955 | Booth | 222/131 |
| 3,338,068 | A | | 8/1967 | Piker | |
| 3,395,550 | A | | 8/1968 | Dungan | |
| 3,959,982 | A | | 6/1976 | Denis et al. | |

(Continued)

OTHER PUBLICATIONS

Igloo Plastic 400 Series water cooler brochure from Igloo website (www.igloocommercial.com), 2002.

*Primary Examiner*—Cheryl Tyler
*Assistant Examiner*—John Pettitt
(74) *Attorney, Agent, or Firm*—Miller Patent Services; Jerry A. Miller

(57) ABSTRACT

A double cooler device consistent with certain embodiments has an outer housing shell and an inner housing shell disposed within the outer housing shell and coupled thereto to form an outer reservoir to make up the housing. An inner core resides within the inner shell to form an inner reservoir. A first tap is coupled to the outer reservoir and a second tap is coupled to the inner reservoir to permit dispensing of a liquid stored in each respective reservoir. The inner reservoir has a drain and a vent spout. A lid is provided for closing the housing. The lid has an outer seal adjacent a periphery thereof to seal the outer reservoir and an inner seal to seal the inner reservoir. When the lid is in a first position with respect to the housing, both the inner and outer reservoirs are sealed by the inner and outer seals and the vent and spout are closed. When the lid is in a second position with respect to the housing, the vent and spout are open to permit draining the inner reservoir without permitting fluid communication between the inner and outer reservoirs. This abstract is not to be considered limiting, since other embodiments may deviate from the features described in this abstract.

20 Claims, 7 Drawing Sheets

U.S. PATENT DOCUMENTS 4,286,440 A 9/1981 Taylor
4,502,295 A 3/1985 Toledo-Pereya
4,633,678 A 1/1987 Lea et al.
4,910,975 A 3/1990 Derby
4,932,563 A * 6/1990 Diamond et al. ..... 222/129
5,295,369 A 3/1994 Garcia
5,328,050 A * 7/1994 Hyatt ..... 220/506
5,329,787 A 7/1994 Friday
5,353,607 A 10/1994 McBride
5,671,611 A 9/1997 Quigley

* cited by examiner

DOUBLE COOLER "THE COOLER COOLER" ICE AND BEVERAGE COMBINATION

CROSS REFERENCE TO RELATED DOCUMENTS

This is a substitute specification submitted for application Ser. No. 10/760,163. The originally submitted specification, including all drawings and claims, is hereby incorporated herein by reference.

COPYRIGHT NOTICE

A portion of the disclosure of this patent document contains material which is subject to copyright protection. The copyright owner has no objection to the facsimile reproduction of the patent document or the patent disclosure, as it appears in the Patent and Trademark Office patent file or records, but otherwise reserves all copyright rights whatsoever.

BACKGROUND

Certain embodiments consistent with the present invention relate to a double cooler device. Several cooler devices are known in the art. For example, U.S. Pat. No. 5,671,611 is a square cooler with a square container inside, that uses a cooler with a relatively narrow coolant compartment immediately within the insulated side walls of the cooler. This coolant compartment surrounds the food and beverage compartment. Each compartment has its own means to drain liquid. Ice can easily be poured into the coolant compartment because of a means for forming a funnel like effect, which funnel like effect extends around its top. There are separate means to seal each compartment at its top against the surrounding ambient temperature, and also provide individual access to each compartment. This patent seems to be designed for the cooling of a food compartment, because of the tightly sealed lids. If it was used for a beverage container it could not possibly provide the same solution as embodiments consistent with the present invention. If this device is used as a beverage cooler it clearly has a ventilation concern. With a tight lid and no means of ventilation to allow an even flow of air, as the beverage is released, the beverage will not readily leave the container, due to the created vacuum.

The current state of the art device used widely, for example in the construction industry, is a five gallon insulated container that is designed and marketed for providing drinking water or other beverages dispersed with a simple faucet near the base. Such coolers are marketed, for example, by Igloo Products Corp.

BRIEF DESCRIPTION OF THE DRAWINGS

Certain illustrative embodiments illustrating organization and method of operation, together with objects and advantages may be best understood by reference detailed description that follows taken in conjunction with the accompanying drawings in which.

Figure 1:
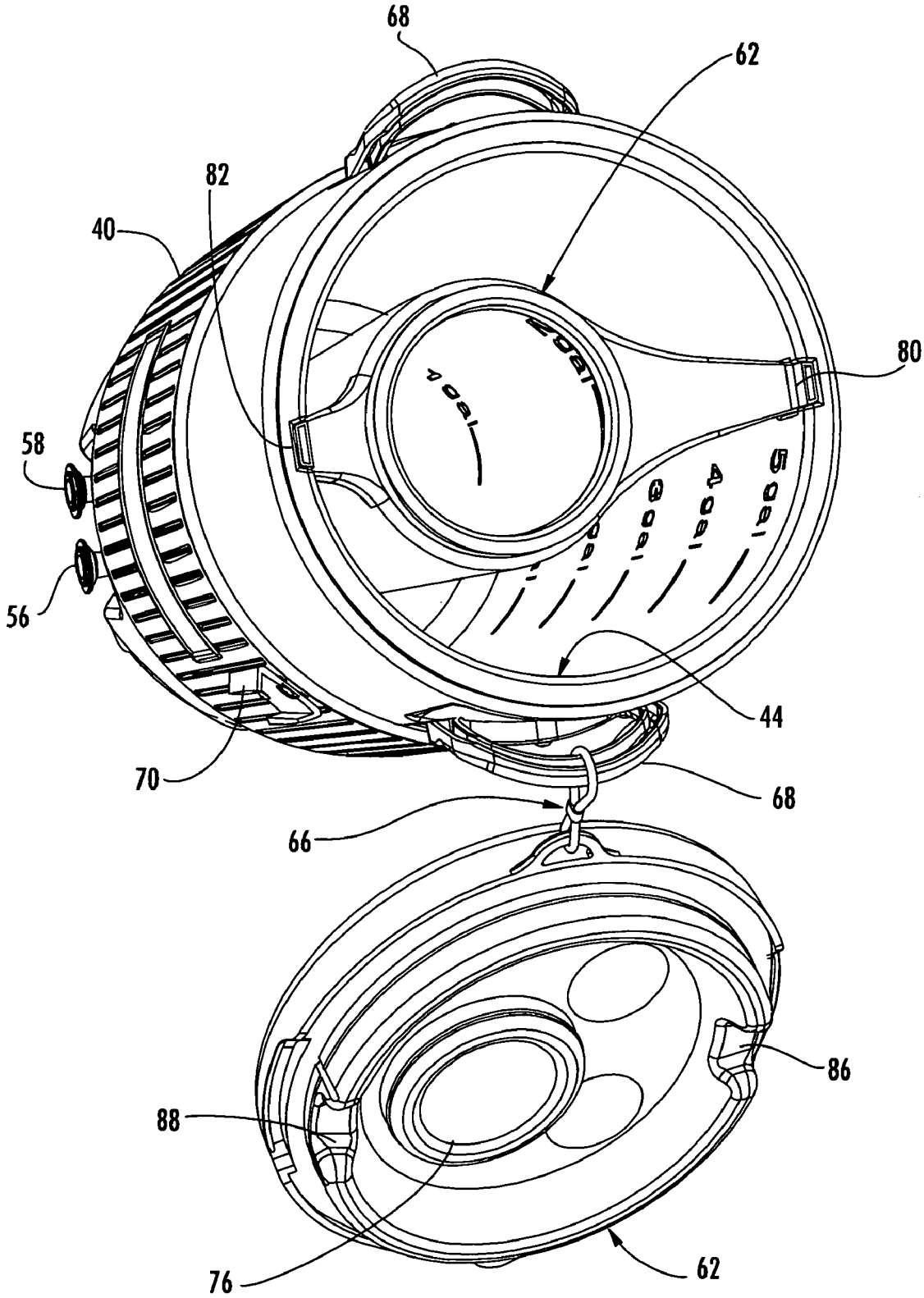
FIG. 1 is a first perspective view of the double cooler consistent with certain embodiments of the present invention.

Additional detailed features of certain embodiments are depicted in engineering drawings A-534-100 through A-534-107 which form a part of the present application as filed and which are hereby incorporated by reference.

DETAILED DESCRIPTION

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation. The various embodiments depicted herein may be referred to has the double cooler or double cooler device generically to refer generally to the various embodiments.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

The double cooler consistent with certain embodiments was developed to overcome certain problems with the current state-of-the-art beverage storage devices widely used by the construction industry and many others. This device is a five gallon insulated container that is designed and marketed for the containment of providing drinking water or other beverage and is dispersed with a simple faucet near the base. Commonly, such devices are used to store water or mineral and electrolyte replenishment beverages such as Gatorade™ beverage (often mixed from a powder). Ice is normally added directly to the beverage to cool the beverage down. One problem observed with this beverage cooler is that it is common that the full five gallons of beverage is not always used in a single day. As a result, the remainder of the beverage is generally either 1) discarded or 2) further diluted the next day by addition of more ice. In the first case, a perfectly good beverage is wasted and in the second case, the effectiveness and taste of the beverage is reduced or otherwise undesirably altered.

The double cooler consistent with certain embodiments provides a solution which keeps the beverage cold while providing a supply of ice water in addition to the beverage. Additionally, the above problems are ameliorated in an ice and beverage combination operable to provide an ice cold beverage without the dilution of melted ice within the beverage. This cooler reduces waste of beverage due to dilution and serves as an ice water dispenser and separate beverage dispenser. Moreover, embodiments consistent with certain embodiments of the present invention permit replacement of the ice without dilution and without loss of the beverage.

In the embodiment described herein, a five gallon version is described, but those skilled in the art will appreciate that other capacities and other design details may be altered without departing from embodiments consistent with the present invention.

Figure 2:
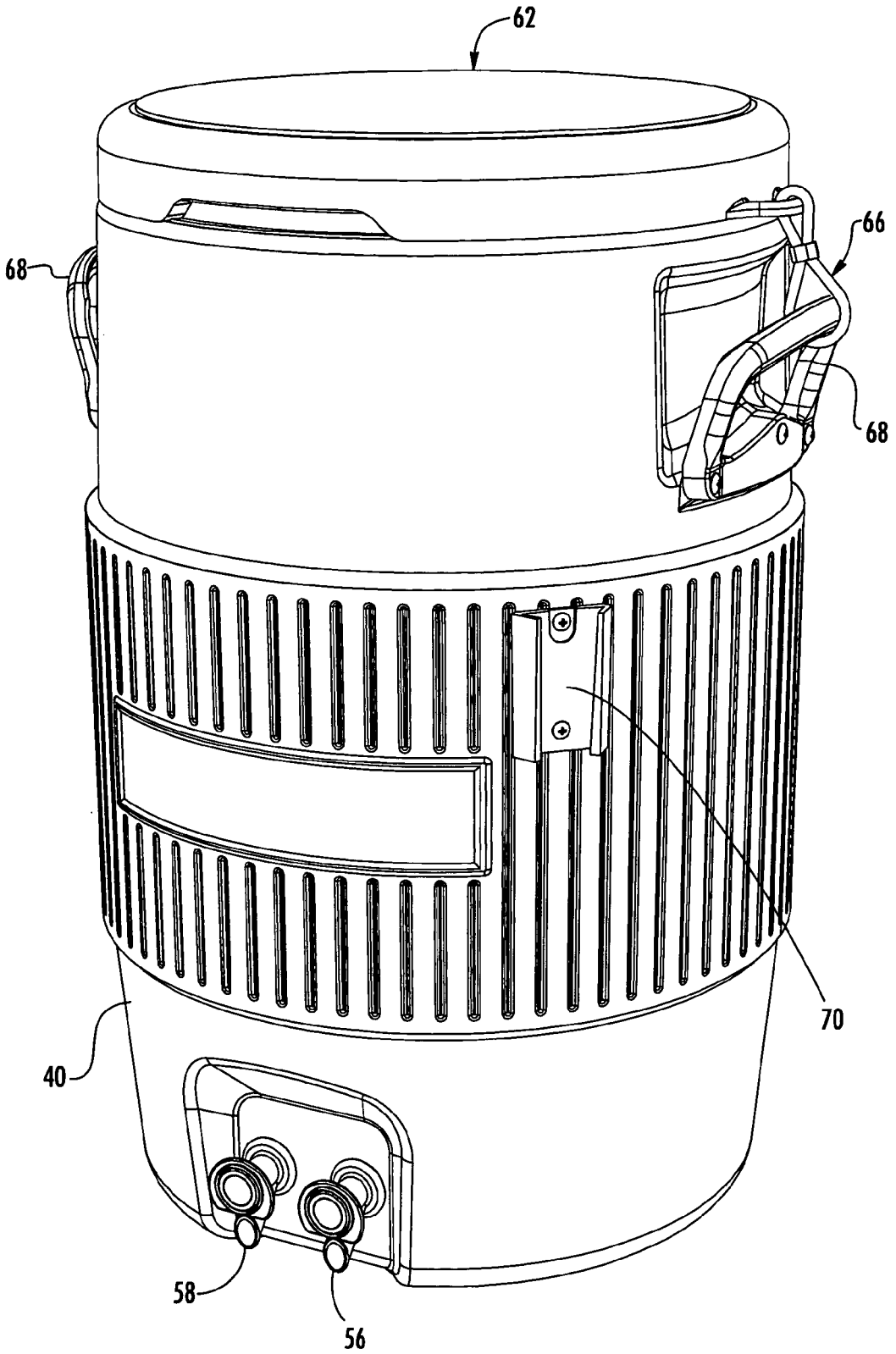
FIG. 2 is a second perspective view of the double cooler consistent with certain embodiments of the present invention.
Figure 3:
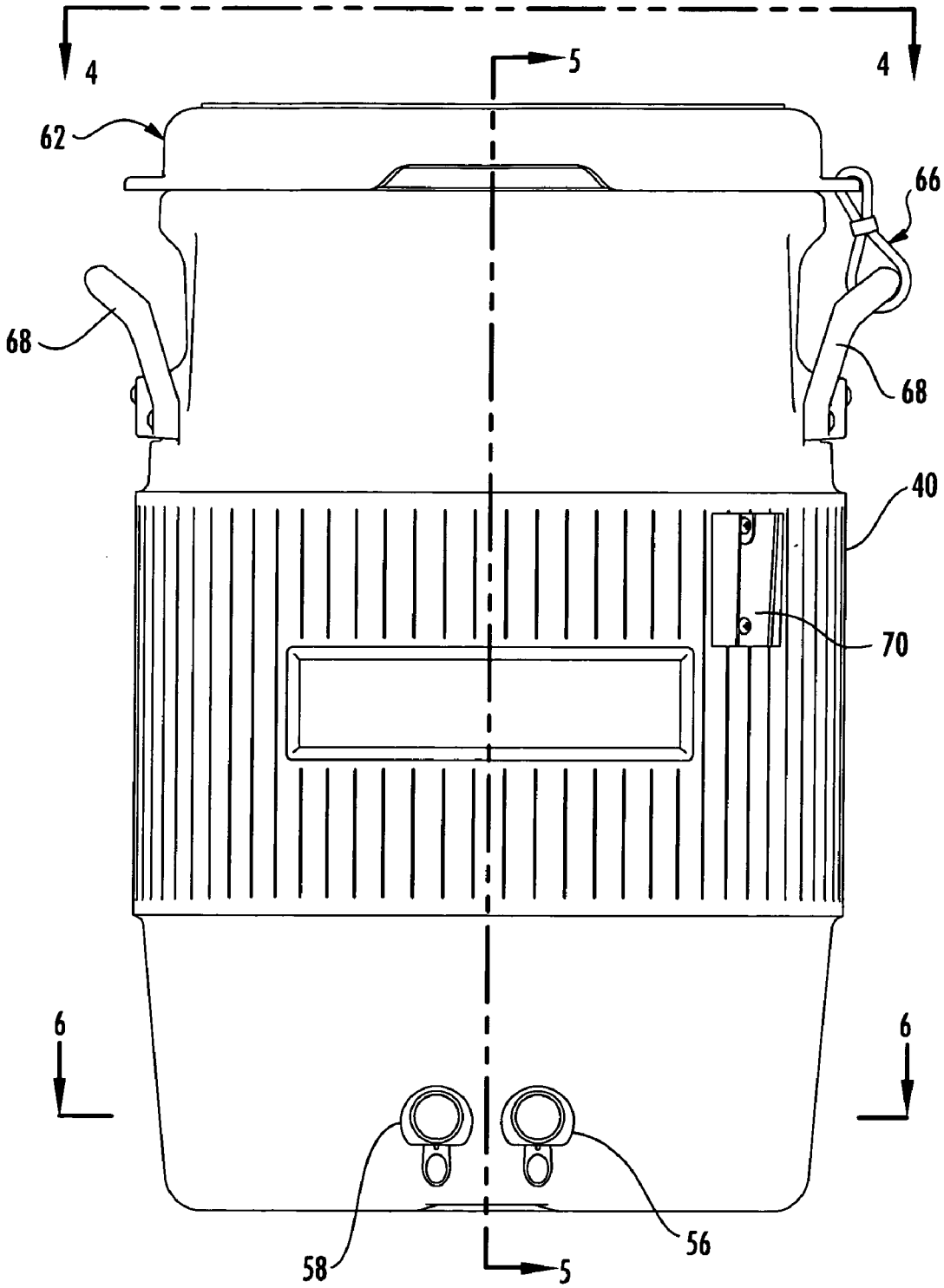
FIG. 3 is a side view of the double cooler consistent with certain embodiments of the present invention.
Figure 4:
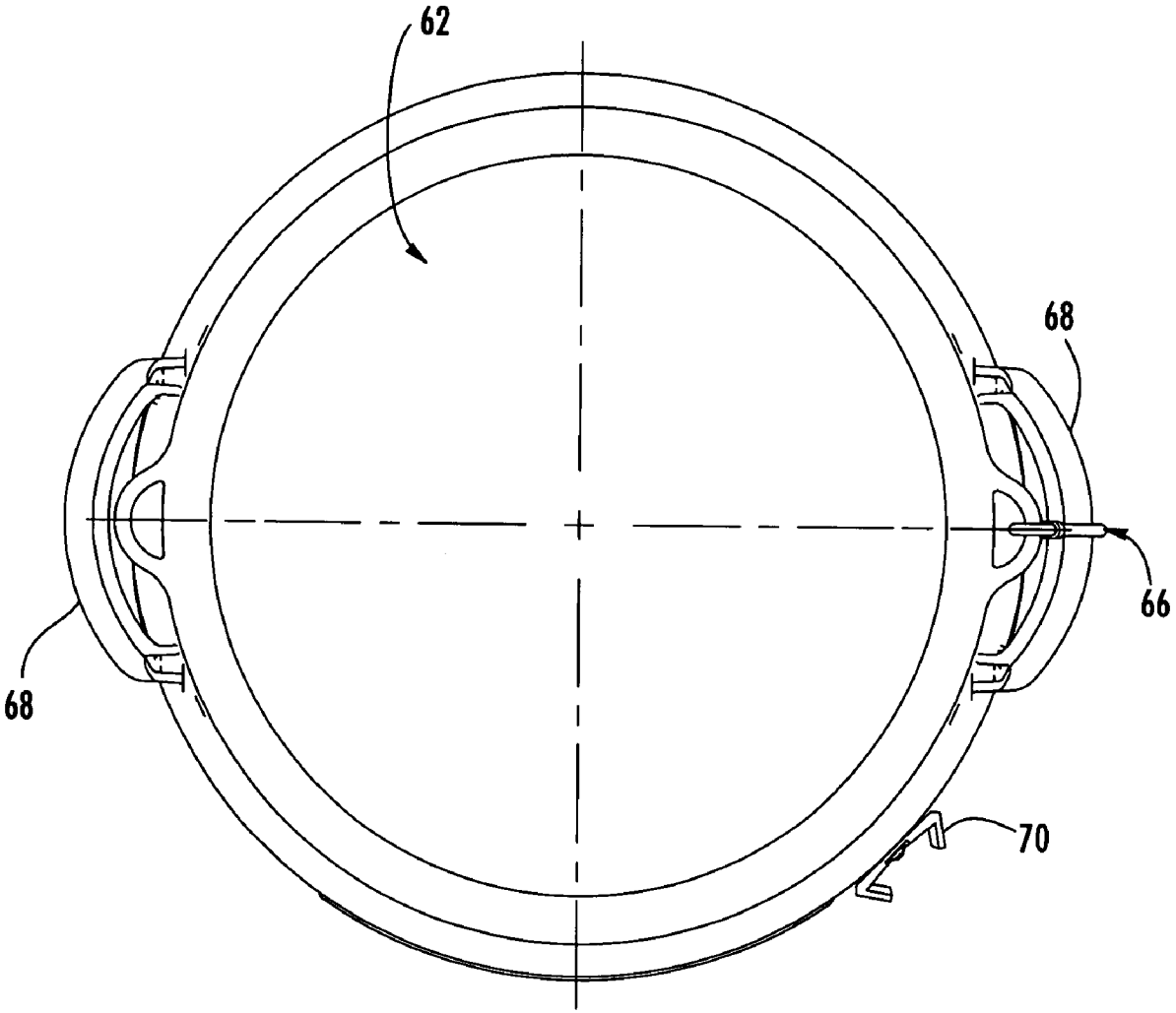
FIG. 4 is a top view of the double cooler consistent with certain embodiments of the present invention.
Figure 5:
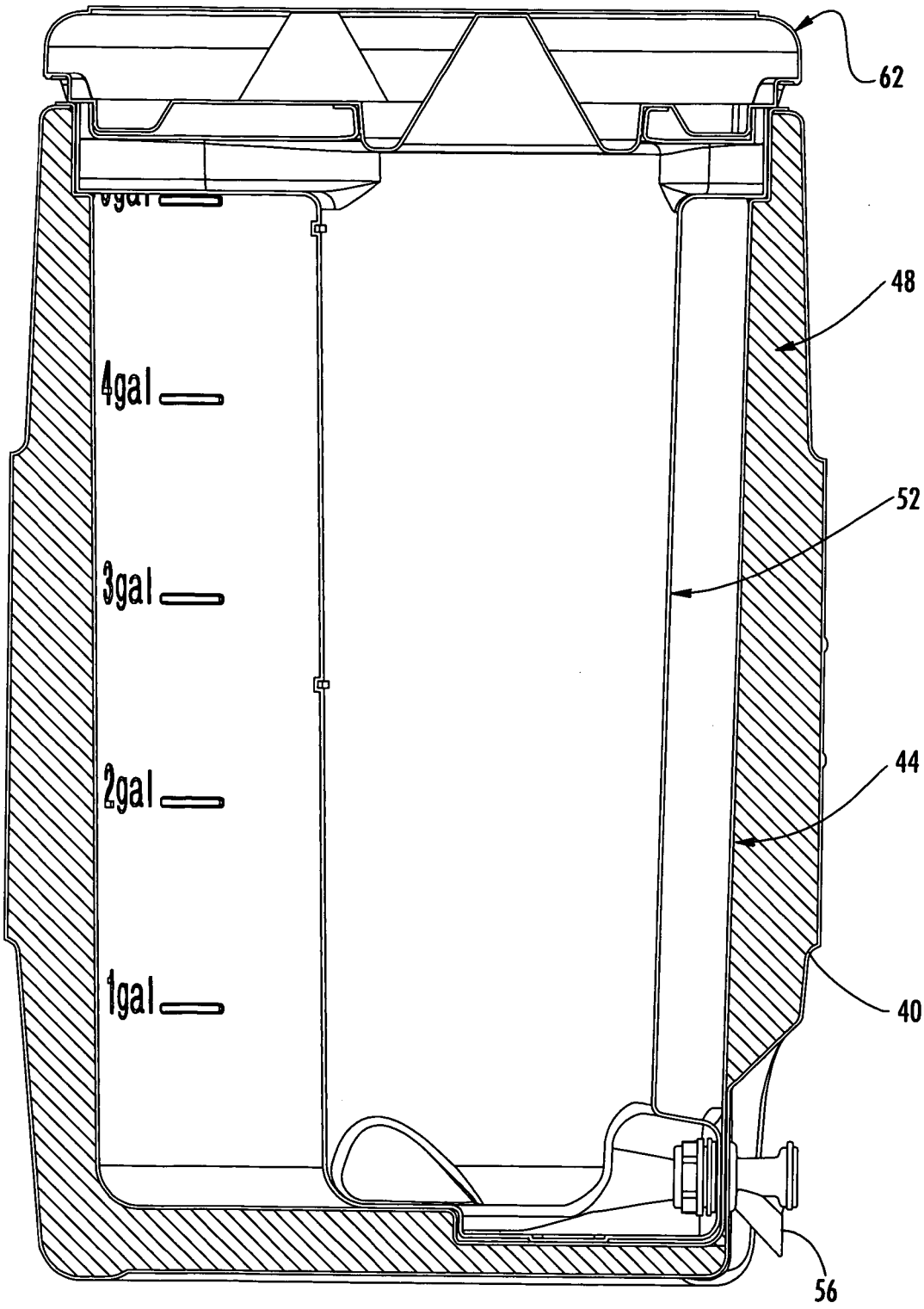
FIG. 5 is a side cross-sectional view of the double cooler consistent with certain embodiments of the present invention.
Figure 6:
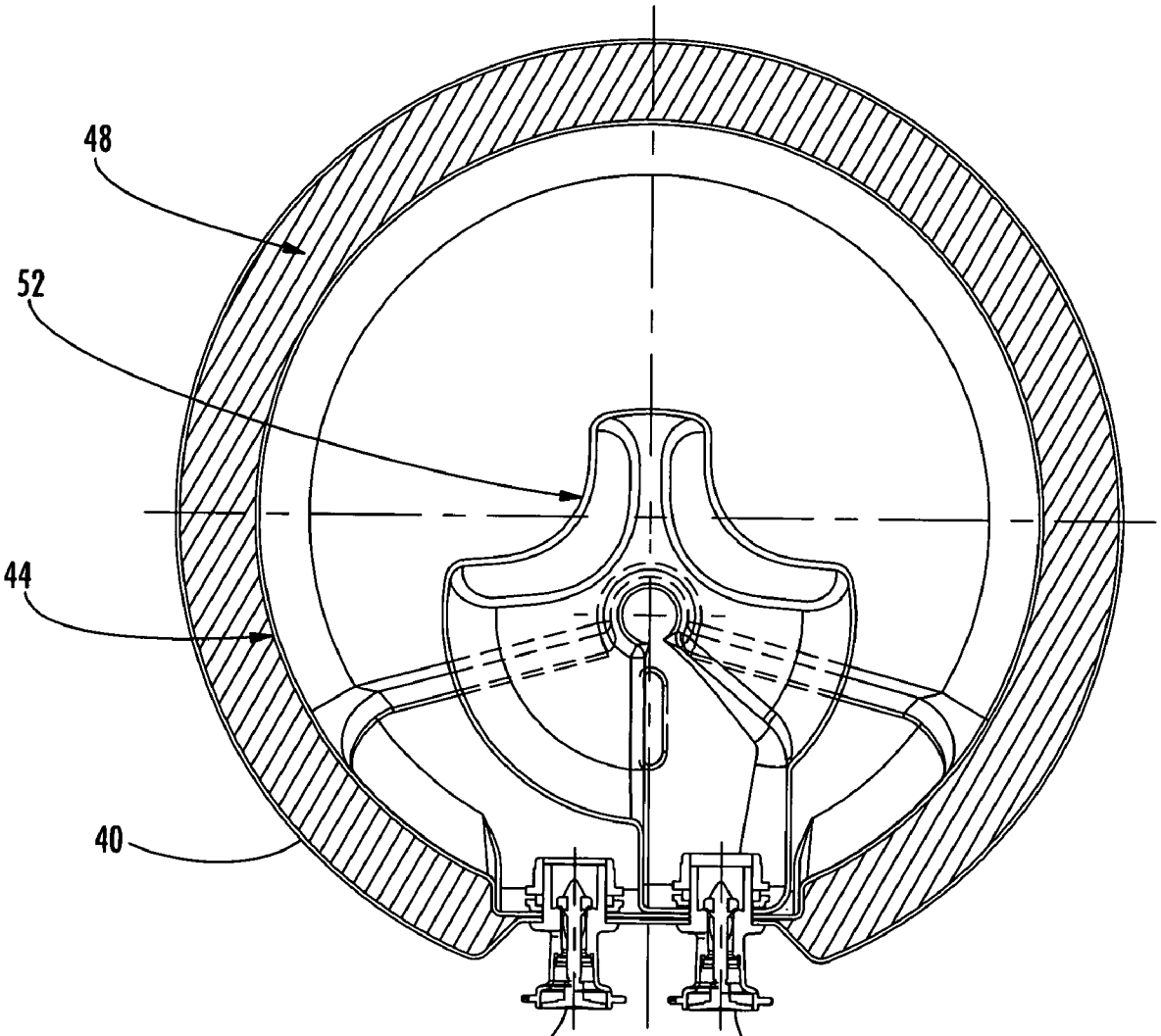
FIG. 6 is a top cross sectional view of the double cooler consistent with certain embodiments of the present invention.
Figure 7:
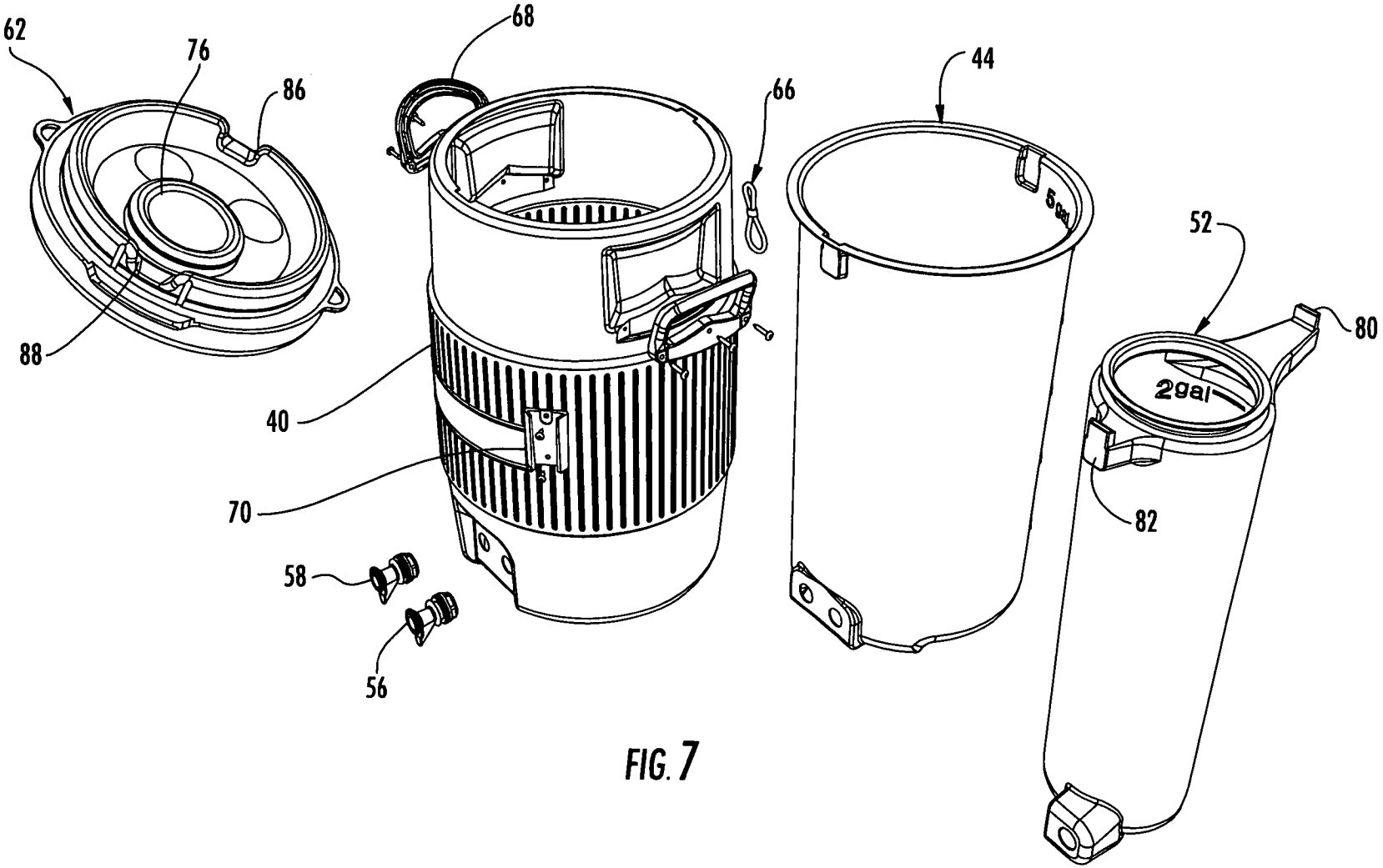
FIG. 7 is an exploded perspective view of the double cooler consistent with certain embodiments of the present invention showing assembly details.

Referring now to FIGS. 1-2, perspective views of an embodiment consistent with the present invention is depicted. Viewed in conjunction with FIGS. 3-7, the full manufacturing and assembly details of the present embodiment will be evident to those skilled in the art. The present embodiment has an outer shell 40 with an inner shell 44 disposed therein. The space between the inner shell 40 and outer shell 44 can be filled in place by injection of foam insulation 48 as depicted in FIGS. 5-6. The core 52 fits within the inner shell 44 and is coupled to tap assembly 56 to provide fluid communication from the core 52 through the tap 46. The space between the core 52 and the inner shell 44 is coupled to tap 58 to provide communication from the space between the core 52 and the inner shell 44 through the tap 58. In use, ice and water (or melting ice) can be placed within the core 52 and accessed through tap 56. A beverage can be placed in the compartment bounded by the outer surface of the core 52 and the inner shell 44 and accessed using tap 58.

The double container thus described can be closed to prevent spills using lid 62. Lid 62 provides a double sealing mechanism to seal the core container 52 and the inner shell 44, as well as a venting and draining mechanism that will be described later. Fluid level indicia can be provided within the inner shell 44 and the core container 52 as shown to facilitate proper mixing of beverages.

In the present embodiment, the core container 52 serves as a container having a capacity of 2 gallons. Its main purpose is to hold ice and/or cold water to provide cooling to the beverage contained in the inner shell 44. The core container 52 is provided with a tap assembly 56 to receive and dispense cold water for consumption as the ice melts. Of course, this and all other statements contained herein of main purpose or primary use are not to be considered limiting in any manner.

In the present embodiment, the inner shell 44 has a capacity of 5 gallons of liquid (with core container 52 in place). The main purpose is to hold a beverage that can be cooled, but stay separated from the ice in the core container 52, to prevent water dilution as the ice melts. The inner shell 44 also has a tap assembly 58 to receive and dispense cooled beverage for non-diluted product consumption through the outer shell 40.

Since the construction industry has discovered that it is very worthwhile to provide an electrolyte and mineral replenishment beverage as an alternative of water for their work crews, the general method of use has been to combine a five-gallon-mix pouch of dry powdered product with water and ice to fill the container. As the ice melts, the product is diluted and thus becomes less effective or otherwise less desirable if reused. Any remaining product must often be discarded, which is inefficient.

Embodiments consistent with the present double cooler provide a five-gallon container that is wrapped around a two-gallon container. There are two simple faucets (taps 56 and 58) at the front where the user can tap from either container. The five-gallon container is suitable for mixing a five-gallon-mix pouch of beverage product with water while the center container is filled with ice and topped off with water. The ice container cools the beverage product without dilution and also provides an ice water option for the user. The push button of the left hand faucet may be color coded (e.g., lemon-lime green) to designate the beverage product: a multi-lingual cue to the mineral and electrolyte replenishment beverage. In addition, certain embodiments consistent with the present invention may also be used for keeping beer or other beverages cold, as a replacement for a "keg".

The embodiment depicted uses a tie 66 to connect the lid 62 to the container by connection to one of a pair of handles 68 connected to the outer shell 40, by screws for example, to prevent the lid 62 from being misplaced. A cup holder bracket 70 can also be provided and attached to the outer shell 40 by screws for example to facilitate mounting of a cup dispenser. The lid 62 is designed to provide both a sealing function and a venting function. When fully engaged with the double cooler and seated in place, both chambers (the core 52 and the inner shell 44) are sealed from each other and from the outside. Core seal 76 seals the central large opening of the core 52 to prevent the fluids from the core and inner shell from intermingling. However, if the lid 62 is lifted up approximately ¼ inch, the core seal 76 remains engaged, but spouts 80 and 82 are revealed through a pair of recesses 86 and 88 in lid 62. This permits the user to quickly drain the fluid from the core container 52 by tilting the cooler and draining the contents. In this action, one spout serves as a drain while the other serves as an air vent. The contents of the inner shell 44 and core container 52 can be accessed to clean or replace/replenish its contents by fully lifting and removing the lid.

Certain embodiments consistent with the present invention through its design and features of the core, venting system, drainage system and the design of the lid clearly provides a excellent container for the means of providing 1) drinking water 2) mineral beverage "non-diluted" 3) and a way to drain the two-gallon container without draining the five-gallon container. The preferred double cooler is "round" in cross section and designed to replace the current state-of-the-art "round" cooler via its size so that will fit into the existing brackets that the contractor may have purchased and mounted on his vehicle.

Thus, a double cooler device consistent with certain embodiments has an outer housing shell and an inner housing shell disposed within the outer housing shell and coupled thereto to form an outer reservoir to make up the housing. An inner core resides within the inner shell to form an inner reservoir. A first tap is coupled to the outer reservoir and a second tap is coupled to the inner reservoir to permit dispensing of a liquid stored in each respective reservoir. The inner reservoir has a drain and a vent spout. A lid is provided for closing the housing. The lid has an outer seal adjacent a periphery thereof to seal the outer reservoir and an inner seal to seal the inner reservoir. When the lid is in a first position with respect to the housing, both the inner and outer reservoirs are sealed by the inner and outer seals and the vent and spout are closed. When the lid is in a second position with respect to the housing, the vent and spout are open to permit draining the inner reservoir without permitting fluid communication between the inner and outer reservoirs.

A double cooler apparatus consistent with certain embodiments has an outer housing shell. An inner housing shell is disposed within the outer housing shell and coupled thereto to form an outer reservoir, wherein the inner and outer housing shells make up a housing. An inner core resides within the inner shell to form an inner reservoir. A first tap is coupled to the outer reservoir and passing through the outer shell to provide access to and permit dispensing of a liquid stored in the outer reservoir. A second tap is coupled to the inner reservoir and passing through both the inner shell and the outer shell to provide access to and permit dispensing of a liquid stored in the inner reservoir. A vent spout is in fluid communication with the inner reservoir and a drain spout is also in fluid communication with the inner reservoir. A lid is provided for closing the housing, the lid having an outer seal adjacent a periphery thereof to seal the outer reservoir and an inner seal to seal the inner reservoir. When the lid is fully engaged with the housing, both the inner and outer reservoirs are sealed by the inner and outer seals and the vent spout and drain spout are closed. When the lid is lifted from full engagement without removal, the vent spout and drain spout are revealed to permit draining the inner reservoir through the drain spout and venting through the vent spout to facilitate the draining, without permitting fluid communication between the inner and outer reservoirs.

As noted above, full engineering drawings were submitted with this application as originally filed. Reference to those drawings, which are incorporated by reference, will provide full manufacturing details of an exemplary embodiment as follows: The present embodiment is a Blow Molded Polyethylene round cooler that has a Core dwg. no. 534-103 and Inner Shell dwg. no. 534-102 and Outer Shell dwg. no. 534-101 and Lid dwg. no. 534-104 and Handle (2 plcs) dwg. no. 534-105 and Screw (2 plcs) and Cup Bracket dwg. no. 534-106 and Screw (2 plcs) and Tap Assy (2 plcs) dwg. no. 534-107 and Tie and Insulation.

The Core dwg. no. 534-103 has a capacity of 2 gallons of liquid. Its main purpose is to hold ice to provide cooling to the beverage contained in the Inner Shell dwg. no. 534-102. The Core is provided with a Tap Assy dwg. no. 534-107 to receive and dispense cooled water obtained from melted ice for cold water consumption through the Outer Shell dwg. no. 534-101. The Core has vents located at the front and the back, at the top of the container. These vents serve, 1) as a system to evenly allow air in which allows a free flow of water out as the Tap Assy dwg. no. 534-107 is used to dispense cooled water from the melted ice for water consumption. 2) By opening the lid a small amount (app. 3/16 inch) and tilting the container to the back, excessive water can be drained from the Core container via the back vent while retaining the beverage and ice. After the water is drained, the Lid dwg. no. 534-104 can be lifted off, this allows supplemental ice to be added to the remaining ice in the Core and retain and use the beverage in the Inner Shell dwg. no. 534-102.

The Inner Shell dwg. no. 534-102 has a capacity of 5 gallons of liquid. Its main purpose is to hold a beverage that can be cooled from the ice separated and contained in the Core dwg. no. 534-103 without the beverage becoming diluted from the ice as it melts. The Inner Shell is provided with a Tap Assy dwg. no. 534-107 to receive and dispense cooled beverage for non-diluted product consumption through the outer Shell dwg. no. 534-101. The vents for the Inner Shell are only at the front. This venting system allows an evenly flow of air in which allows a free flow of beverge out as the Tap Assy dwg. no. 534-107 is used to dispense the beverage from the Inner Shell. The Inner Shell is also designed to allow room for cans if desired to be stored.

The Outer Shell dwg. no. 534-101 contains the Core dwg. no. 534-103 and the Inner Shell dwg. no. 534-102 foamed in place for insulation. The Outer Shell assembly includes two Tap Assy dwg. no. 534-107.1) to receive and dispense cooled water obtained from melted ice for cold water consumption from the Core dwg. no. 534-103 and 2) to receive and dispense cooled beverage for non-diluted beverage consumption from the Inner Shell dwg. no. 534-102. It has two Handles dwg. no. 534-105 attached by two screws operable for grasping and conveying the entire cooler and a Cup Bracket dwg. no. 534-106 attached by two screws and a Tie to attach the Lid dwg. no. 534-104 to one of the handles dwg. no. 534-105.

The lid is Blow Molded Polyethylene especially designed to make this invention work. It is designed to 1) keep the Core dwg. no. 534-103 and the Inner Shell dwg. no. 534-102 containers clean by providing as a enclosure. 2) It allows ventilation of air to the Core dwg. no. 534-103 and to the Inner Shell dwg. no. 534-102 containers allowing a free flow of beverage during the use of the Tap Assy dwg. no. 534-107 to receive and dispense water or cooled beverage for non-diluted product consumption through the outer Shell dwg. no. 534-101.3) By opening the lid a small amount (app. 3/16 inch) and tilting the container to the back, excessive water can be drained from the Core dwg. no. 534-103 container via the back vent while retaining the beverage and ice. 4) To the side of the Lid is a molded loop for the placement of the Tie to prevent Lid loss. 5) The Lid has two areas for the placement of fingers for the ease of lifting the Lid. The embodiment depicted in these engineering drawings is to be considered illustrative with the particular details depicted not limiting on the broader invention.

Those skilled in the art will appreciate that the embodiment depicted in the originally filed engineering drawings should not be considered limiting since other embodiments can also be realized without departing from teachings consistent with the present invention. While certain illustrative embodiments have been described, it is evident that many alternatives, modifications, permutations and variations will become apparent to those skilled in the art in light of the foregoing description.

What is claimed is:

1. A double cooler apparatus, comprising in combination:

an outer housing shell;

an inner housing shell disposed within the outer housing shell and coupled thereto to form an outer reservoir, wherein the inner and outer housing shells comprise a housing;

an inner core residing within the inner shell to form an inner reservoir;

a first tap coupled to the outer reservoir and passing through the outer shell to provide access to and permit dispensing of a liquid stored in the outer reservoir;

a second tap coupled to the inner reservoir and passing through both the inner shell and the outer shell to provide access to and permit dispensing of a liquid stored in the inner reservoir;

a vent spout in fluid communication with the inner reservoir;

a drain spout in fluid communication with the inner reservoir; and a lid for closing the housing, the lid having both an outer seal adjacent a periphery thereof to seal the outer reservoir and an inner seal to seal the inner reservoir, wherein, when the lid is fully engaged with the housing, both the inner and outer reservoirs are sealed by the inner and outer seals and the vent spout and drain spout are closed, wherein, the vent spout and the drain spout extend in a radial direction from the inner core and mate with recesses in the lid, wherein, when the lid is lifted from full engagement without removal from engagement with the housing, the vent spout and drain spout are revealed and the inner seal is opened to permit draining the inner reservoir through the drain spout and venting through the vent spout to facilitate the draining, without permitting fluid communication between the inner and outer reservoirs, and wherein, when the lid is removed from engagement with the housing, both the inner and outer seals are unsealed to open the inner and outer reservoirs.

2. The double cooler apparatus according to claim 1, further comprising a cup holder bracket coupled to the outer shell.

3. The double cooler apparatus according to claim 1, further comprising a pair of handles coupled to the outer shell to facilitate lifting of the double cooler apparatus.

4. The double cooler apparatus according to claim 3, further comprising a tie coupling the lid to at least one of the handles.

5. The double cooler apparatus according to claim 1, further comprising means for coupling the lid to the outer shell.

6. The double cooler apparatus according to claim 1, wherein the inner reservoir has a fluid capacity of approximately two gallons.

7. The double cooler apparatus according to claim 1, wherein the outer reservoir has a fluid capacity of approximately five gallons excluding the capacity of the inner reservoir.

8. The double cooler apparatus according to claim 1, wherein the housing has an approximately circular cross-section.

9. The double cooler apparatus according to claim 1, further comprising foam insulation injected between the inner and outer shells.

10. A double cooler apparatus, comprising in combination:

an outer housing shell;

an inner housing shell disposed within the outer housing shell and coupled thereto to form an outer reservoir, wherein the inner and outer housing shells comprise a housing;

a layer of insulation disposed between the inner and outer shells;

an inner core residing within the inner shell to form an inner reservoir;

a first tap coupled to the outer reservoir and passing through the outer shell to provide access to and permit dispensing of a liquid stored in the outer reservoir;

a second tap coupled to the inner reservoir and passing through both the inner shell and the outer shell to provide access to and permit dispensing of a liquid stored in the inner reservoir;

venting means in fluid communication with the inner reservoir, for providing air venting to the inner reservoir;

draining means in fluid communication with the inner reservoir, for providing a drain for fluid within the inner reservoir; and a lid for closing the housing, the lid having both an outer seal adjacent a periphery thereof to seal the outer reservoir and an inner seal to seal the inner reservoir, wherein, when the lid is in a first position with respect to the housing, both the inner and outer reservoirs are sealed by the inner and outer seals and the venting means and the draining means are closed, wherein, the vent spout and the drain spout extend in a radial direction from the inner core and mate with recesses in the lid, wherein, when the lid is in a second position with respect to the housing, the venting means and draining means are opened to permit draining the inner reservoir through the draining means and venting through the venting means to facilitate the draining, without permitting fluid communication between the inner and outer reservoirs, and wherein, when the lid is removed from engagement with the housing, both the inner and outer seals are unsealed to open the inner and outer reservoirs.

11. The double cooler apparatus according to claim 10, further comprising a cup holder bracket coupled to the outer shell.

12. The double cooler apparatus according to claim 10, further comprising a pair of handles coupled to the outer shell to facilitate lifting of the double cooler apparatus.

13. The double cooler apparatus according to claim 12, further comprising a tie coupling the lid to at least one of the handles.

14. The double cooler apparatus according to claim 10, further comprising means for coupling the lid to the outer shell.

15. The double cooler apparatus according to claim 10, wherein the inner reservoir has a fluid capacity of approximately two gallons.

16. The double cooler apparatus according to claim 10, wherein the outer reservoir has a fluid capacity of approximately five gallons excluding the capacity of the inner reservoir.

17. The double cooler apparatus according to claim 10, wherein the housing has an approximately circular cross-section.

18. A double cooler apparatus, comprising in combination:

an outer housing shell;

an inner housing shell disposed within the outer housing shell and coupled thereto to form an outer reservoir, wherein the inner and outer housing shells comprise a housing, and wherein the housing has an approximately circular cross-section;

a foam insulation layer injected between the inner and outer shells;

an inner core residing within the inner shell to form an inner reservoir having fluid capacity of approximately two gallons, and wherein the fluid capacity of the inner housing shell with the inner core in place is approximately five gallons;

a pair of handles coupled to the outer shell to facilitate lifting of the double cooler apparatus;

a first tap coupled to the outer reservoir and passing through the outer shell to provide access to and permit dispensing of a liquid stored in the outer reservoir;

a second tap coupled to the inner reservoir and passing through both the inner shell and the outer shell to provide access to and permit dispensing of a liquid stored in the inner reservoir;

a vent spout in fluid communication with the inner reservoir;

a drain spout in fluid communication with the inner reservoir; and a lid for closing the housing, the lid having both an outer seal adjacent a periphery thereof to seal the outer reservoir and an inner seal to seal the inner reservoir, wherein, when the lid is fully engaged with the housing, both the inner and outer reservoirs are sealed by the inner and outer seals and the vent spout and drain spout are closed, wherein, the vent spout and the drain spout extend in a radial direction from the inner core and mate with recesses in the lid, and wherein, when the lid is lifted from full engagement with the housing without removal from engagement from the housing, the vent spout and drain spout are revealed and the inner seal is opened to permit draining the inner reservoir through the drain spout and venting through the vent spout to facilitate the draining, without permitting fluid communication between the inner and outer reservoirs, wherein, when the lid is removed from engagement with the housing, both the inner and outer seals are unsealed to open the inner and outer reservoirs; and means for coupling the lid to the outer shell.

19. The double cooler apparatus according to claim 1, further comprising a cup holder bracket coupled to the outer shell.

20. The double cooler apparatus according to claim 3, wherein the means for coupling the lid to the outer shell comprises a tie coupling the lid to at least one of the handles.

* * * * *